US005860265A

United States Patent [19]

Knudson et al.

[11] Patent Number: 5,860,265

[45] Date of Patent: Jan. 19, 1999

[54] METAL BEAMS WITH THERMAL BREAK AND METHODS

[76] Inventors: Gary A. Knudson, 30401 Heavenly Ct., Evergreen, Colo. 80439; Patrick D. Flood, 276 Eagle Dr., Golden, Colo. 80403

[21] Appl. No.: 919,986

[22] Filed: Aug. 28, 1997

Related U.S. Application Data

[62] Division of Ser. No. 612,107, Mar. 7, 1996, Pat. No. 5,720,144.

[51] Int. Cl.[6] ..... E04C 3/07; E04C 3/29

[52] U.S. Cl. ..... 52/731.9; 52/731.1; 52/745.19; 29/509; 29/897.3; 29/897.35

[58] Field of Search ..... 52/745.19, 717.02, 52/730.1, 730.3, 730.6, 731.1, 731.7, 731.8, 731.9, 733.2, 736.1, 737.1; 29/509, 897.35, 897.3

[56] References Cited

U.S. PATENT DOCUMENTS

| | | | |
|---|---|---|---|
| 102,441 | 4/1870 | Siddons | 52/528 X |
| 425,002 | 4/1890 | Sagendorf | 52/528 |
| 3,335,524 | 8/1967 | Carson | 52/717.02 X |
| 3,872,633 | 3/1975 | Altosaar et al. | 52/238 |
| 3,925,953 | 12/1975 | LaBorde | 52/745.19 |
| 3,967,430 | 7/1976 | Knudson | 52/745.19 |
| 4,131,980 | 1/1979 | Zinnbauer | 29/463 |
| 4,160,312 | 7/1979 | Nyssen | 29/509 X |
| 4,161,811 | 7/1979 | Nyssen | 29/509 X |
| 4,267,679 | 5/1981 | Thompson | 52/311 |
| 4,688,366 | 8/1987 | Schmidt | 52/731 |
| 5,074,138 | 12/1991 | Miller | 29/509 X |
| 5,228,257 | 7/1993 | Bowersox et al. | 52/588.1 |
| 5,390,466 | 2/1995 | Johnson et al. | 52/796 |
| 5,424,111 | 6/1995 | Farbstein | 428/137 |
| 5,568,714 | 10/1996 | Peterson | 52/786.13 |
| 5,720,144 | 2/1998 | Knudson et al. | 52/731.1 X |

FOREIGN PATENT DOCUMENTS

| | | | |
|---|---|---|---|
| 7496 | 2/1980 | European Pat. Off. | 52/730.3 |
| 2013267 | 8/1979 | United Kingdom | 52/730.3 |

*Primary Examiner*—Robert Canfield
*Attorney, Agent, or Firm*—Ancel W. Lewis, Jr.

[57] ABSTRACT

A metal beam with a thermal break between opposite sides and method of making is disclosed. In a first embodiment a huck rivet extends through aligned holes in a pair of opposed beam sections having a base wall portion and a side wall portion. In a second embodiment a punch/swedge operation forms a rivet in the base wall portion of one beam section that extends through the other base wall portion of the other beam section. In a third embodiment a series of spaced, alternating tabs and recesses are formed in the beam section and the tabs overlap and are riveted at overlapping tabs only to form a gap in the formed beam. In a fourth embodiment oppositely opening hooks are formed in the inner sections of first and second beam sections that interfit and are seamed together to fasten the two beam sections with a continuous seam along the center of a composite beam.

17 Claims, 5 Drawing Sheets

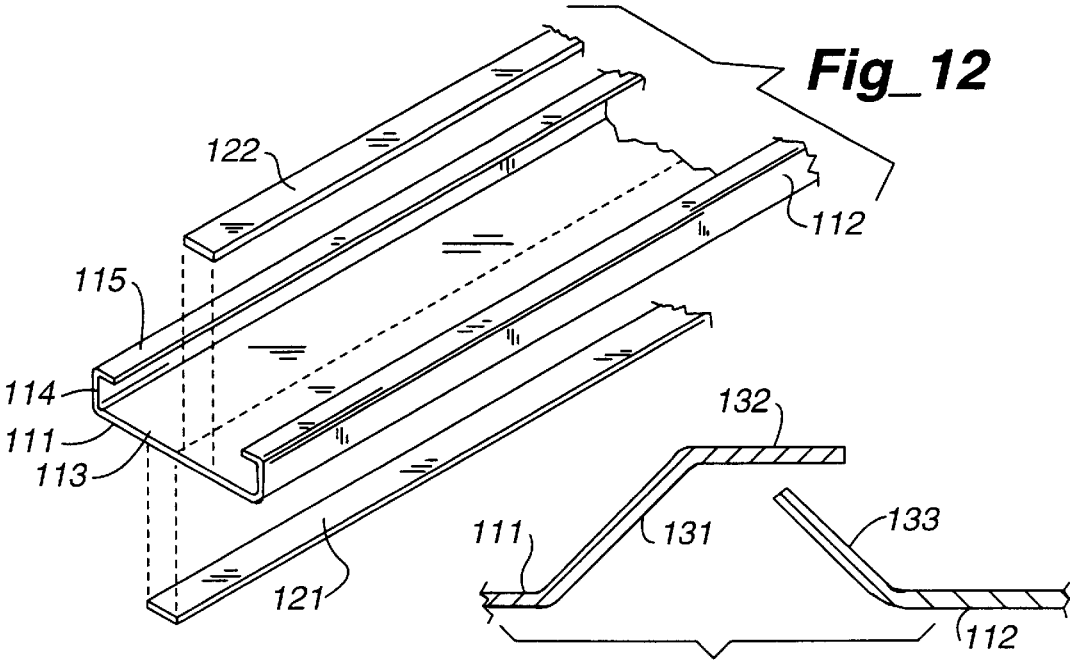
Fig_12
Fig_13
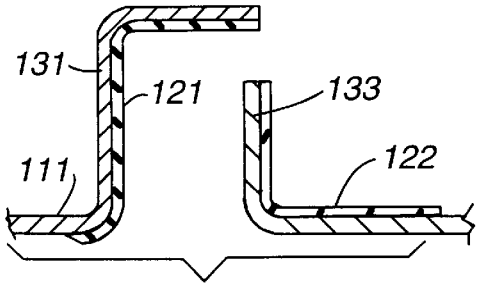
Fig_14
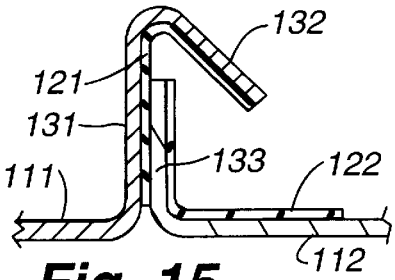
Fig_15
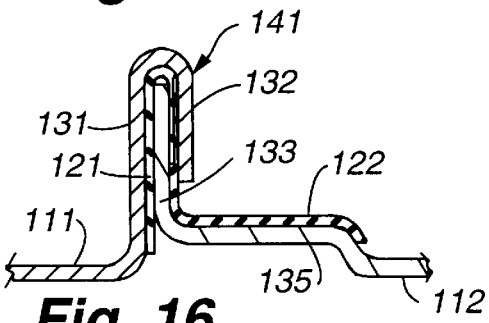
Fig_16
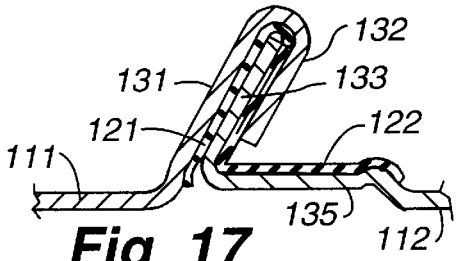
Fig_17
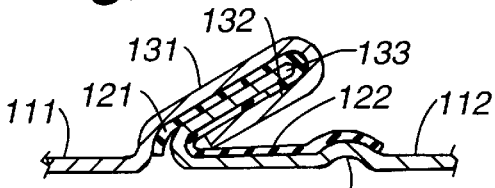
Fig_18
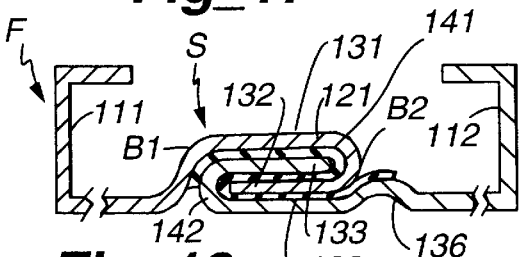
Fig_19

METAL BEAMS WITH THERMAL BREAK AND METHODS

This application is a division of application Ser. No. 08/612,107, filed Mar. 7, 1996, now U.S. Pat. No. 5,720,144 (status, abandoned, pending, etc.).

TECHNICAL FIELD

This invention relates generally to sheet metal beams or studs and more particularly to sheet metal beams that are used as the tracks and studs of a building frame assembly.

BACKGROUND ART

In the past, wooden beams referred to as studs have been used as the top and bottom beams of a building frame assembly and more recently sheet metal beams or studs have been provided for this purpose.

There are thermal insulation problems inherently associated with steel or sheet metal beams. Steel or sheet metal beams in frames produce a thermal bridge between either side of a wall frame, joist, or truss member or like metal structural components. This thermal bridging readily transfers heat across metal members, which results in excessive heating/cooling costs, condensation, and accelerated thermal rot in sheeting materials like drywall and siding. Heat transfer utilizes three basic mechanisms; conduction, radiation, and convection. With typical wood framing, the wood itself is an insulator, which eliminates conduction. Effective thermal sheeting and batten insulation prevent radiation across the frame and convection within the dead space. With steel sheet metal framing, the metal conducts heat across the frame. Sheeting and batten insulation reduce radiation and convection, but no satisfactory means has been provided to prevent conduction. Several approaches to reducing conduction involved reducing the amount of material in the web of a sheet metal beam, but no method to completely eliminate conduction in a sheet metal beam has heretofore been provided.

The patents to Farmer U.S. Pat. No. 4,071,995, Larsen U.S. Pat. No. 4,691,493 and Marschak U.S. Pat. No. 5,117,602 are directed to metal beams fabricated from roll-formed beam half sections but none teach a heat insulating layer interposed between the metal of opposite beam half sections.

Blomstedt U.S. Pat. No. 4,016,700, Rutkowski U.S. Pat. No. 4,435,936, Taylor U.S. Pat. Nos. 4,619,098 and 4,638,615 and Gilmour U.S. Pat. No. 5,285,615 relate to metal beams but have a thermal reduction feature such as slits, dimples or protuberances.

DISCLOSURE OF THE INVENTION

A metal beam with a thermal break between opposite sides has first and second beam sections each with a base wall portion and a side wall portion which form a channel member with opposed, spaced side wall portions and a base wall when the two sections are fastened together. A thermal insulation layer is fastened between the first and second base portions to thermally isolate or provide a thermal break between the first and second beam sections.

In a first embodiment there are opposed first and second beam sections and the base wall portion of one beam section overlaps the base wall portion of the other beam section and aligned holes in the base wall portions are of an equal size. A tubular rivet body with a heat insulation layer on the outside is compressed at the ends to form a huck rivet to secure the beam sections together to form a composite beam.

In a second embodiment there is a larger hole over a smaller hole in the overlapping base wall portions with a heat insulation layer between the overlapping base wall portions and a punch and die tool uses the material of the bottom wall portion surrounding the smaller hole to swedge form a rivet to fasten the bottom wall portions to form a composite beam.

In a third embodiment opposed first and second beam sections each with oppositely disposed inner edges and inner sections have a series of spaced, alternating tabs and recesses. Each tab has a hole. These beam sections preferably are provided by longitudinally splitting a channel beam or roll forming separate beam sections. These first and second beam sections are disposed side by side, the holes are aligned and a thin gap is provided between the opposed inner edges and only the opposed tabs overlap with a layer of thermal insulation between opposed tabs. Either a huck rivet or a punch/swedge rivet may be used on the overlapping tabs to fasten these beam sections to form a composite beam.

In a fourth embodiment opposed first and second beam sections are seamed together along opposed inner sections of the bottom wall portions. These beams have adjacent inner sections of the bottom wall portions that are gradually formed as seam section shapes, preferably oppositely facing interfitting hooks with a layer of heat insulation disposed between the hooks by a continuous roll forming process to secure the two beam sections together with a tight, continuous, seam to form a composite beam.

BRIEF DESCRIPTION OF THE DRAWINGS

Details of this invention are described in connection with the accompanying drawings which like parts bear similar reference numerals in which:

FIG. 12 is an exploded view of two opposed beam sections shown separated by a dashed line with two layers of heat insulation that are shown in a separated position.

FIG. 13 is a sectional view showing the first stage of inner section shaping of the bottom wall portions of the two beam sections.

FIG. 14 is a sectional view showing a second stage of inner section shaping with the heat insulation in place.

FIG. 15 is a sectional view showing a third stage of inner section shaping.

FIG. 16 is a sectional view showing a fourth stage of inner section shaping.

FIG. 17 is a sectional view showing a fifth stage of inner section shaping.

FIG. 18 is a sectional view showing a sixth stage of inner section shaping.

FIG. 19 is a sectional view showing the final stage of inner section shaping which form the continuous seam in the central part of the beam.

DETAILED DESCRIPTION

Figure 1:
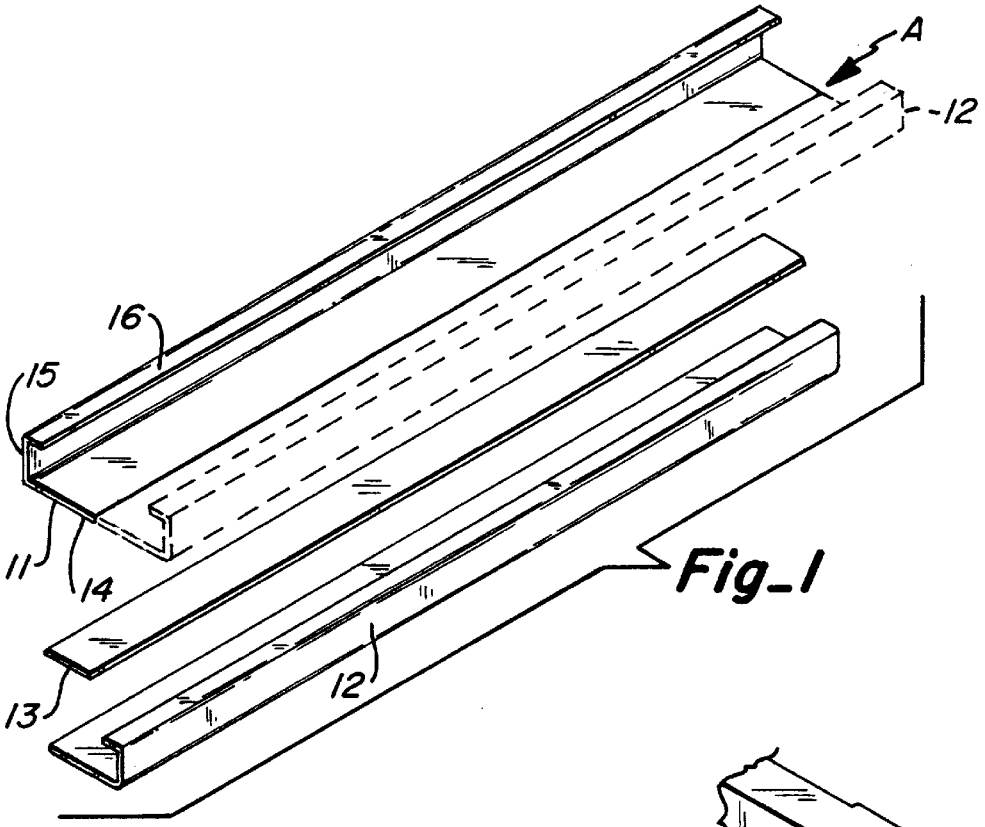
FIG. 1 is an exploded perspective view of the parts of a metal beam in a separated condition before assembly with one of the beam sections shown in dashed lines and the opposed beam section in full lines.
Figure 2:
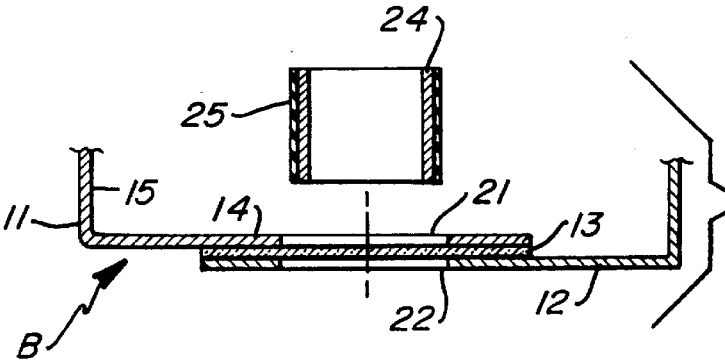
FIG. 2 is a cross-sectional view of the parts of the metal beam prior to being fastened with a huck rivet tubular body shown prior to being placed in a fastening position in the holes.
Figure 3:
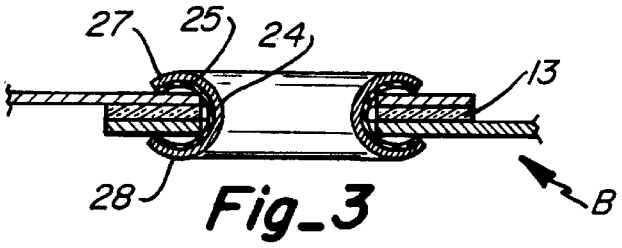
FIG. 3 is a sectional view showing the huck rivet flanged at both ends to fasten the beam sections tightly together.

Referring now to FIGS. 1–3 there is shown a pair of oppositely disposed, roll formed, generally L-shaped top beam section 11 and bottom section 12 with portions that are overlapped with a layer of heat or thermal insulation 13 placed between the overlapping portions. Beam sections 11 and 12 are fastened together to form a generally channel-shaped composite beam B (FIG. 2). Each of the beam sections 11 and 12 are of an identical size and shape and have a base wall portion 14, a side wall portion 15 extending transverse to the base wall portion and an inturned top flange portion 16. These beam sections 11 and 12 may be formed individually using a roll forming machine or in the alternative as shown in FIG. 1 an oversized channel-shaped member A with parallel spaced side walls and inturned top flange portions is roll formed and is longitudinally cut or slit down the center of the bottom wall of a single channel-shaped beam to form the two beam sections 11 and 12 that are then overlapped and has the layer of heat insulation 13 placed between the overlapping portions of the opposed base wall portions of the beam sections as shown in FIG. 2.

There are two preferred methods of fastening or attaching the above described beam sections 11 and 12. The first method is herein referred to as roll riveting. In the roll riveting method a hole 21 is formed in the base wall portion of beam section 11 and a hole 22 of the same size as hole 21 is formed in the base wall portion of beam section 12. These holes 21 and 22 preferably are stamped or punched. The top beam section 11 overlaps the bottom beam section 12 with holes 21 and 22 arranged in alignment. A layer of heat or thermal insulation 13 is placed between the two overlapping bottom wall portions so there is no metal to metal contact between the two sections and a huck rivet 24 extends through the aligned holes 21 and 22. The huck rivet begins as a cylindrical tubular body of a selected length with a layer of heat or thermal insulation 25 on the outer surface. A rivet forming tool is used having oppositely positioned dies and a means to apply pressure from opposite directions to the dies to flatten both ends of the tubular body. This pressure produces end rivet heads 27 and 28 of a semi-circular shape. The tool is similar to the one disclosed in my copending application Ser. No. 289,272 discussed hereafter but has conventional opposed rivet head forming dies.

Figure 6:
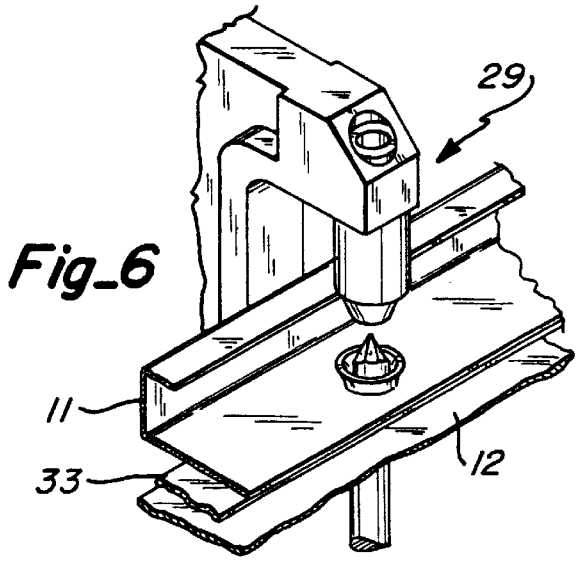
FIG. 6 is a perspective view of a tool for performing the punch/swedge riveting operation shown in FIGS. 4 and 5.
Figure 4:
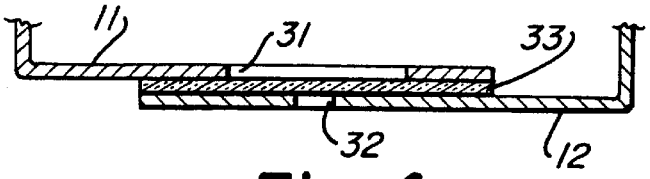
FIG. 4 is a sectional view showing two beam sections with a larger hole over a smaller hole.
Figure 5:
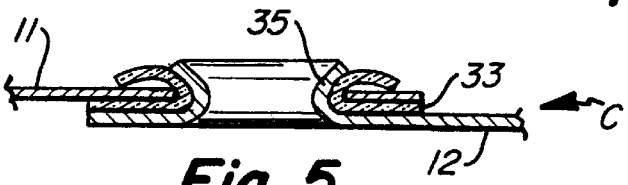
FIG. 5 is a sectional view showing the two beam sections of FIG. 4 fastened with a punch/swedge riveting operation.
Figure 8:
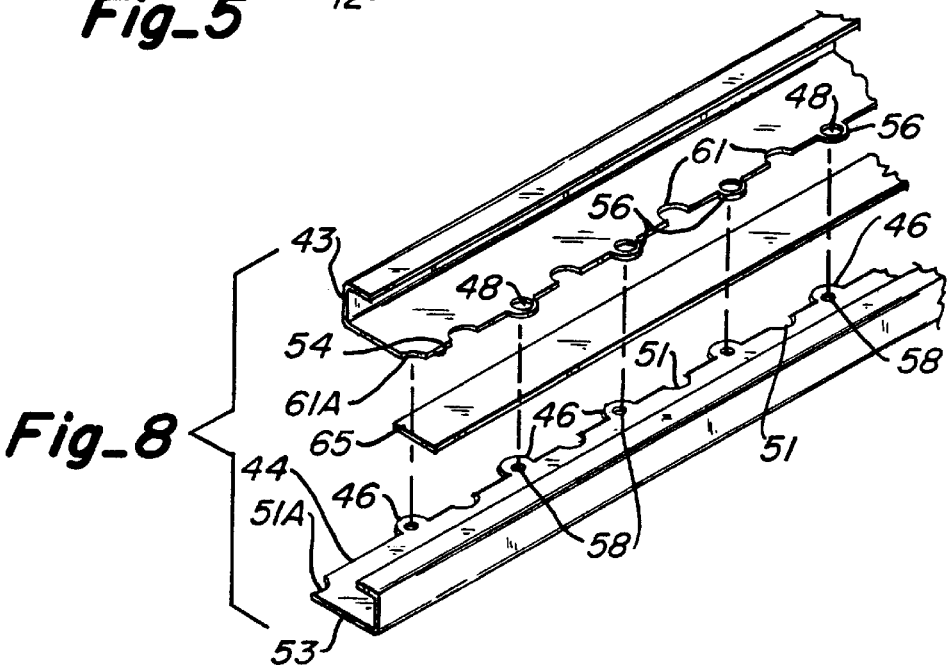
FIG. 8 is an exploded perspective view of the opposed two beam sections punched and cut from the beam of FIG. 7 shown in a separated condition before assembly.
Figure 7:
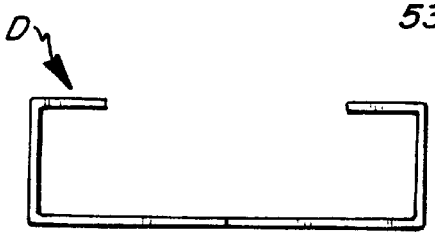
FIG. 7 is an end view of a channel-shaped beam.

A second method of attaching the beam sections 11 and 12 is called the punch/swedge riveting. As shown in FIGS. 4 and 5 in this procedure a larger hole 31 is formed in the bottom wall portion of a top beam section 11 and a smaller hole 32 in the bottom beam section 12. The two bottom wall portions are overlapped and the centers of the holes 31 and 32 are aligned. A layer of heat insulation 33 is placed between the overlapping portions of the beam sections and then a rivet fastening die is used to swedge the material of the bottom wall portion of the bottom 12 surrounding hole 32 to form a circumferential rivet head 35 above the top surface of the bottom wall portion 12. This procedure produces a channel-shaped composite beam designated C. Referring now to FIG. 6 there is shown a tool 29 and dies and operation for performing the punch/swedge riveting. The details are disclosed in my copending application Ser. No. 289,272 and incorporated herein by reference.

In yet a third embodiment shown in FIGS. 7–11 a channel-shaped member D is formed preferably using a continuous roll forming process. Preferably a punch or stamping operation is used to punch a selected length of the member to form a first beam section 43 with an inner edge 54, a series of alternating spaced, semi-circular tabs 56 extending out from the inner edge 54 and semi-circular recesses 61 extending in from the inner edge 54. A larger hole 48 is provided in each tab 56. The selected length of the beam provides half recesses 51A at each end.

Figure 9:
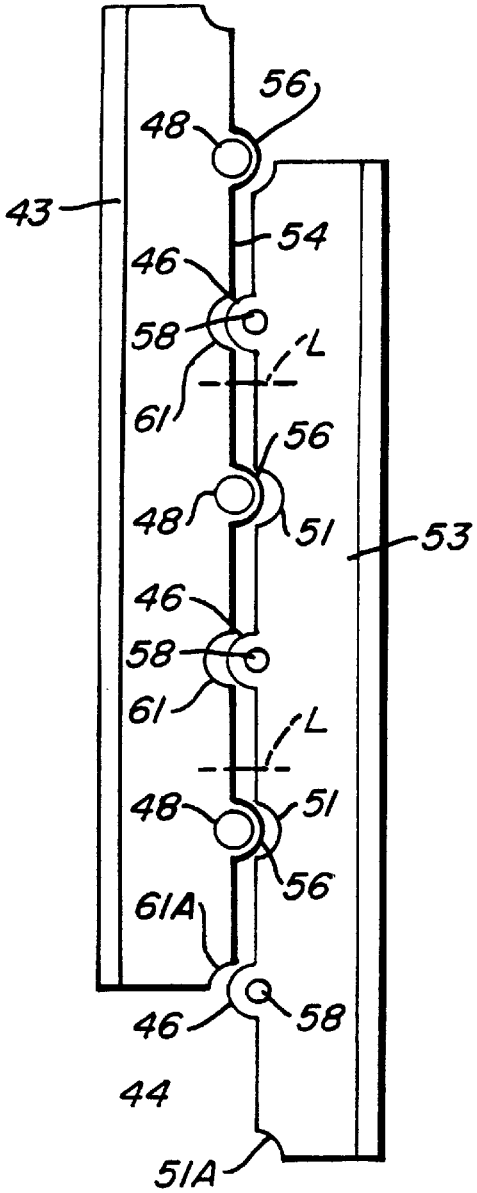
FIG. 9 is a top plan view of the two opposed beam sections.
Figure 10:
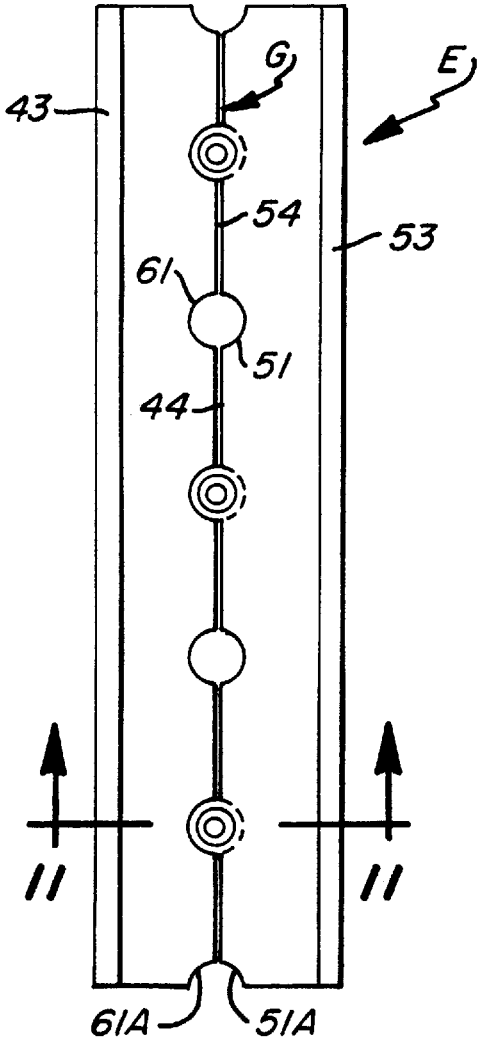
FIG. 10 is a top view of the assembled beam using the sections shown in FIGS. 8 and 9.
Figure 11:
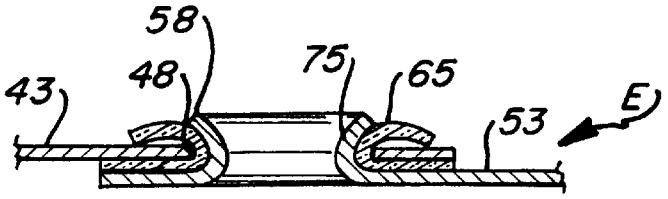
FIG. 11 is a sectional view taken along lines 11—11 of FIG. 10.
Figure 20:
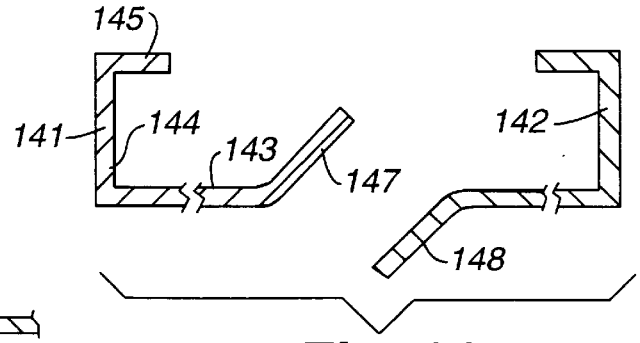
FIG. 20 is a sectional view showing the first stage of inner section shaping of two beams in yet another embodiment.
Figure 21:
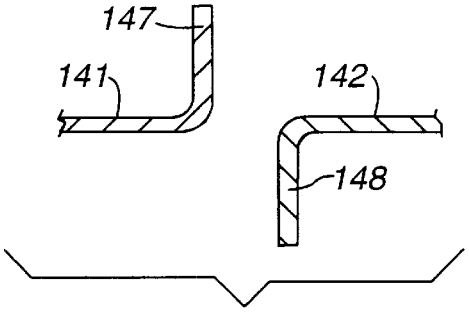
FIG. 21 is a sectional view showing a second stage of inner section shaping.
Figure 22:
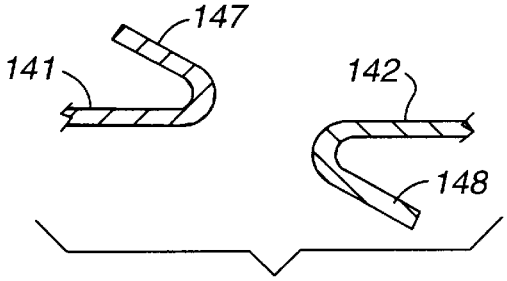
FIG. 22 is a sectional view showing a third stage of inner section shaping.

A second beam section 53 opposite the first beam section 43 has an inner edge 44, a series of spaced, alternating semi-circular tabs 46 extending out from the inner edge 44 and semi-circular recesses 51 extending in from the inner edge 44. A smaller hole 58 is provided in each tab 46. The length along the member C for which punching is accomplished is a selected distance greater than the distance between a tab and a recess as indicated by the distance between lines L. Once the two beam sections 43 and 53 are formed to a selected length after successive punching the opposed inner edges of the two seams are spaced apart and the tabs from opposite beam sections overlap as is shown in FIG. 9 with a layer of heat or thermal insulation 65 between the overlapping tabs. A punch/swedge riveting operation as above described is shown as used to form a rivet head 75 at the top of the base wall portion of the second base section using the material of the base wall portion of second beam section 53 to form a generally channel-shaped composite beam D.

When the beam sections 43 and 53 are placed side by side the larger hole 48 is over the smaller hole 58. In this way a major portion of the bottom wall portions of the beam sections along opposed edges 44 and 54 form a gap G and do not overlap. This process can also use the roll riveting technique above described by using equal sized holes and a huck rivet to fasten the sections together as above described.

Referring now to FIGS. 12–19 of the drawings there is shown a pair of oppositely disposed roll-formed generally L-shaped first and second beam sections 111 and 112. Each of the beam sections 111 and 112 are of an identical size and shape and have a base wall portion 113, a side wall portion 114 extending transverse to the base wall portion and an inturned top flange portion 115. These beam sections may be made by having each section being continuously roll-formed or by roll-forming an oversized channel-shaped member and then longitudinally splitting that member down the middle as is represented in dashed lines in FIG. 12. In the first and second L-shaped beam sections 111 and 112 the adjacent inner edge sections are gradually roll-formed as shown in FIGS. 13–19 to form first and second seam shapes that are seamed together to provide a continuous seam S which fastens the base wall portions of the two together to form a generally channel-shaped composite beam F. Between the first and second beam sections during the roll forming process there are added two heat or thermal insulation layers 121 and 122 which will thermal isolate the first and second beam sections. Each of the first and second beam shapes preferably are continuously roll formed to form the connecting seam S.

Referring now to FIG. 13 an inner section of the base wall portion of first beam section 111 is turned up through an angle of about 45 degrees to form an outwardly inclined section 131 and an end section 132 is bent or turned back down through an angle of about 45 degrees so an end section 132 is horizontally disposed. The opposite inner section 133 of beam section 112 is turned up through an angle of about 45 degrees. The second stage (FIG. 14) turns inner section 131 another 45 degrees so this section is transverse to the plane of back wall portion 113 and section 132 is now transverse or normal to the associated section 131. A thermal layer 121 is positioned along the outer face of inner section 131 and under inner section 132. Thermal layer 122 is positioned along an inner face of inner section 133 and the top face of a portion of the bottom wall of beam section 112 as shown in FIG. 14. At the next stage (FIG. 15) the two upright sections 131 and 133 are brought together and section 132 is turned down through an angle of about 45 degrees. At stage four (FIG. 16) the bottom wall portion of the first beam section 111 is turned through an angle of about 90 degrees a selected distance along the bottom wall portion from inner section 133 to provide a stepped up section 135 and at the same time end section 132 is turned down through another angle of about 45 degrees to form a hook H1 that embraces inner section 133 and layer 131. At stage five (FIG. 17) the hook H1 made of sections 131 and 132 is turned through an angle of about 30 degrees and in the succeeding stage six (FIG. 18) is turned about another 30 degrees while at the same time pushing stepped up section 135 down to form a bend B2 extending in an upward direction by making an upwardly projecting indentation or a dimple 136 in the bottom surface of the bottom wall portion of beam section 112. At stage seven (FIG. 19) the hook H1 having an opening made of sections 131 and 132 is turned down another 30 degrees to a flat or horizontal position and also form a second hook H2 having an opening made up of sections 133 and 135 to complete seam S. This seam S is known in the trade as a Pittsburgh-type seam and has been previously used in downspouts. During stages four through seven (FIGS. 16–19) a bend B1 is formed in the bottom wall portion of beam section 111 that extends in a downward direction and is opposite, transverse to and spaced from the opening in hook H1. Bend B1 is opposite hook H2 and serves as a stop to prevent hooks H1 and H2 from becoming unhooked. Similarly bend B2 is formed in the bottom wall portion of beam section 112 and is opposite, transverse to and spaced from the opening in hook H2 and is opposite hook H1 and serves as a stop to prevent interhooking hooks H1 and H2 from becoming unhooked. Bends B1 and B2 are in opposite sides of seam S.

Referring now to FIGS. 20–25, in yet another embodiment there is shown a pair of oppositely disposed, roll-formed, generally L-shaped first and second beam sections 141 and 142. Each of the beam sections are identical in size and shape and again have the base wall portion 143, side wall portion 144, and top flange portion 145. These beam sections may be made by having each section continuously roll-formed or by roll-forming an oversized channel-shaped member and then longitudinally slitting that member down the middle as above described. At the first stage (FIG. 20) an inner section 147 of the base wall portion 143 of the first beam section is turned up at an angle of about 30 degrees while the opposite inner section 148 on the base wall portion of the second beam section 142 is turned down at an angle of about 30 degrees. At the next stage (FIG. 21) inner section 147 is turned up about 60 degrees to be upright and at about 90 degrees to the associated base wall portion and inner section 148 is turned down about 60 degrees to be an about 90 degrees to the associated base wall portion. At the third stage (FIG. 22) the inner section 147 is turned back another about 45 degrees and inner section 147 back another angle about 45 degrees. At stage 4 (FIG. 23) the inner sections 147 and 148 are turned another about 45 degrees to extend back parallel to the associated back wall portion and form a hook. H3 having an opening on first beam section 141 and a hook H4 having an opening on second beam section 142. A layer of heat insulation 151 is placed over inner section 147 and a layer of heat insulation 152 is placed under inner section 148. The two hooks H3 and H4 are then hooked together or interhooked so there is in effect a hook in a hook with the openings in the hooks facing in opposite directions and the insulation layers 151 and 152 separate the adjacent metal sections. In the final stage (FIG. 25) the hooks H3 and H4 then are crimped down to form a tight continuous seam T and thereby form a generally channel-shaped composite beam G. In the final stage an indentation or dimple 155 in the bottom surface of the base wall portion 143 of beam section 141.

Bend B3 extends transverse to, is spaced from and is opposite the opening in hook H3. Bend B3 is opposite hook H3 and serves as a stop to prevent interhooking hooks H3 and H4 from separating. During the final stage a bend B4 is formed in the bottom wall portion of beam section 142 that extends in a downward direction and extends transverse to, is opposite and spaced from the opening in hook H4. Bend B4 is opposite hook H3 and serves as a stop to prevent hooks H3 and H4 from being unhooked. Bends B3 and B4 are on opposite sides of seam T.

Figure 23:
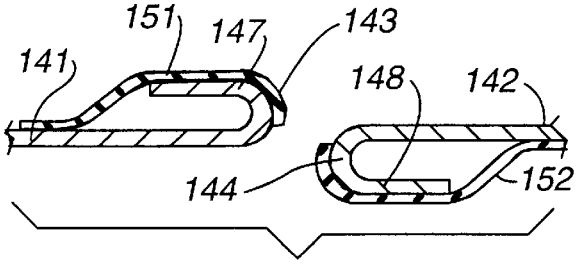
FIG. 23 is a sectional view showing a fourth stage of further inner section shaping and the application of two layers of thermal insulation.
Figure 23A:
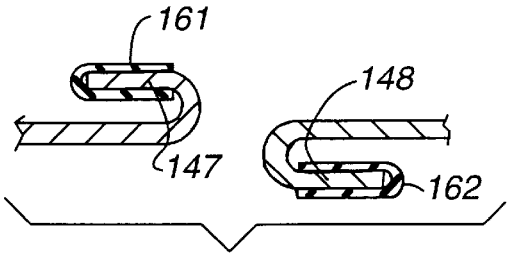
FIG. 23A is a sectional view of an alternative form of insulation layer for each beam section.
Figure 24:
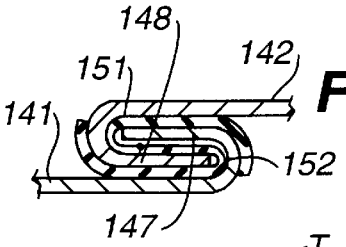
FIG. 24 is a sectional view showing the inner sections brought together.

Referring now to FIG. 23A an alternative to the strips of heat insulation layers 151 and 152 is to provide a U-shaped strip or extrusion 161 and 162 that will slide over the turned back end section of the hooks before the hooks are hooked together.

Figure 26:
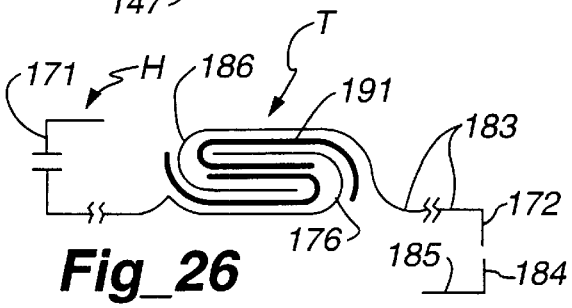
FIG. 26 is a schematic diagram of Z-section beam embodying features of the present invention.
Figure 25:
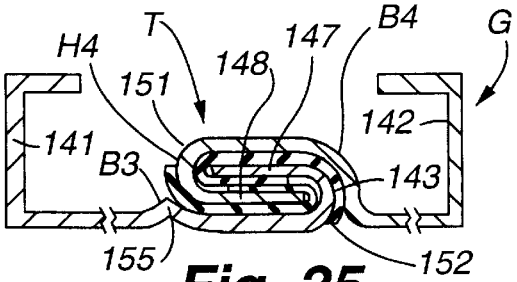
FIG. 25 is a sectional view showing a final stage and the position of the inner sections after a final seaming operation to form the composite beam.

Referring now to FIG. 26 there is shown a Z-section beam H comprised of a first beam section 171 and a second beam section 172. The first beam section 171 is the same as the first beam section 141 above described and has a base wall portion, upturned side wall portion and in inturned top flange portion along with an up and backturned hook 176 at the inner end of the base wall portion. The second beam section 172 has a base wall portion 183, a downturned side wall portion 184 and an inturned top flange portion 185 with a down and backturned hook 186 at the inner end of the base wall portion. A layer of heat insulation 191 is placed between the hooks so there is no metal-to-metal contact to form a tight, continuous seam T similar to the layers 151 and 152 and the seam shown in FIG. 25. It is understood that the Z-section beam H above described may be made from any of the above described processes involving riveting, swedging and roll forming.

Although the present invention has been described with a certain degree of particularity, it is understood that the present disclosure has been made by way of example and that changes in details of structure may be made without departing from the spirit thereof.

What is claimed is:

1. A metal beam with a thermal break between opposite sides comprising:

a first metal beam section including a first base wall portion and first side wall portion extending transverse to said first base wall portion, a second metal beam section opposite said first beam section, said second beam section including a second base wall portion and a second side wall portion extending transverse to said second base wall portion, said first and second base wall portions being oppositely disposed and having adjacent first and second inner edges, said first and second base wall portions being in an overlapping relation to one another to provide overlapping portions, a thermal barrier between said overlapping portions of first and second base wall portions to thermally isolate said first and second beam sections, and fastening means to mechanically fasten said first and second base wall portions together adjacent said inner edges with said thermal barrier between said overlapping portions of said first and second base wall portions to form a structural composite beam, said fastening means being provided by first and second inner sections extending from said first and second inner edges along said first and second base wall portions, said first and second inner sections being roll formed to form a first hook having a first opening in said first section and a second hook having a second opening in said second section interhooking with said first hook, a bend in one of said base wall portions of one of said beam sections, said bend being disposed opposite and extending transverse to the opening of the hook of said one beam section and opposite the hook of the other of said beam sections to prevent separation of said interhooking hooks, said hooks being compressed together by roll forming to form a continuous seam along the center of said composite beam to provide a rigid connection between said first and second beam sections that is not separated by loading forces on said composite beam.

2. A beam as set forth in claim 1 wherein said first inner section is gradually shaped into a downturned first hook and said second inner section has an upturned end section fitting within said first hook, said thermal barrier being between said first hook and said second inner section, said first hook and end section being turned from an upright to a horizontal position to form said second hook interhooking with said first hook.

3. A beam as set forth in claim 1 wherein said first inner section is gradually shaped into an upwardly extending and back turned first hook and said second inner section into a downwardly extending and back turned second hook, said first and second hooks opening in opposite directions and interhooking together with said thermal barrier being between said first and second hooks.

4. A beam as set forth in claim 3 wherein said thermal barrier is provided by U-shaped strips of heat insulation that extend over the end sections of each of said first and second hooks.

5. A beam as set forth in claim 1 wherein said composite beam is generally channel-shaped.

6. A metal beam with a thermal break between opposite sides comprising:

a first metal beam section including a first base wall portion and a first side wall portion extending transverse to said first base wall portion, a second metal beam section opposite said first beam section, said second beam section including a second base wall portion and a second side wall portion extending transverse to said second base wall portion, said first and second base wall portions being in a juxtaposed relation and having adjacent first and second inner edges, said first and second base wall portions being in an overlapping relation to one another to provide overlapping portions, a layer of thermal insulation between overlapping portions of said first and second base wall portions to thermally isolate said first and second beam sections, and fastening means to fasten said first and second base wall portions together adjacent said inner edges with said layer of thermal insulation between opposed portions of said first and second base wall portions to form a composite beam, said fastening means being provided by first and second inner sections extending from said first and second inner edges and along said first and second base wall portions, said first and second inner sections being roll-formed so as to be compressed together to form a continuous seam along the center of said composite beam, said first inner section being gradually shaped into a downturned first hook having a first opening and said second inner section having an upturned end section fitting within said first hook, said layer of thermal insulation being between said first hook and said second inner section, said first hook and end section being turned from an upright to a horizontal position by roll forming to form a second hook having a second opening interhooking with said first hook, a bend in one of said base wall portions of one of said beam sections, said bend being disposed opposite and extending transverse to the opening of the hook of said one beam section and opposite the hook of the other of said beam sections to prevent separation of said interhooking hooks, said first and second hooks being compressed together by roll forming to form a continuous seam along the center of said composite beam to provide a rigid connection between said first and second beam sections that is not separated by loading forces on said composite beam.

7. A metal beam with a thermal break between opposite sides comprising:

a first metal beam section including a first base wall portion and a first side wall portion extending transverse to said first base wall portion, a second metal beam section opposite said first beam section, said second beam section including a second base wall portion and a second side wall portion extending transverse to said second base wall portion, said first and second base wall portions being in a juxtaposed relation and having adjacent first and second inner edges, a layer of thermal insulation between said first and second base wall portions to thermally isolate said first and second beam sections, and fastening means to mechanically fasten said first and second base wall portions together adjacent said inner edges with said thermal layer between opposed portions of said first and second base wall portions to form a structural composite beam, said fastening means being provided by first and second inner sections extending from said first and second inner edges and along said first and second base wall portions, said first and second inner sections being roll-formed to form a continuous seam along the center of said composite beam, said first inner section being gradually shaped into an upwardly extending and back turned first hook having a first opening and said second inner section into a downwardly extending and back turned second hook having a second opening, said first and second hooks opening in opposite directions and interhooking together with said thermal layer being between said first and second hooks and said hooks being compressed together to form said composite seam, a bend in one of said base wall portions of one of said beam sections, said bend being disposed opposite and extending transverse to the opening of the hook of said one beam section and opposite the hook of the other of said beam sections to prevent separation of said interhooking hooks.

8. A metal beam with a thermal break between opposite sides comprising:

a first metal beam section including a first base wall portion and a first side wall portion extending transverse to said first base wall portion, a second metal beam section opposite said first beam section, said second beam section including a second base wall portion and a second side wall portion extending transverse to said second base wall portion, said first and second base wall portions being oppositely disposed and having adjacent first and second inner edges, a thermal barrier between said first and second base wall portions to thermally isolate said first and second beam sections, and fastening means to fasten said first and second base wall portions together adjacent said inner edges with said thermal barrier between opposed portions of said first and second base wall portions to form a composite beam, said fastening means being provided by first and second inner sections extending in from an inner edge and along said first and second base wall portions, said first and second inner sections having a first hook having a first opening in said first section and a second hook having a second opening in said second section interhooking with said first hook, said first and second hooks being compressed together by roll forming to form a continuous seam along the center of said composite beam that is not separated by loading forces on said composite beam, and a bend in one of said base wall portions of one of said beam sections, said bend being disposed opposite and extending transverse to the opening of the hook of said one beam section and opposite the hook of the other of said beam sections to prevent separation of said interhooking hooks.

9. A beam as set forth in claim 8 wherein said composite beam is generally of a Z-section shape.

10. A beam as set forth in claim 8 wherein there is a bend in each of said base wall portions on opposite sides of said seam.

11. A metal beam with a thermal break between opposite sides comprising:

a first metal beam section including a first base wall portion and a first side wall portion extending transverse to said first base wall portion, a second metal beam section opposite said first beam section, said second beam section including a second base wall portion and a second side wall portion extending transverse to said second base wall portion, said first and second base wall portions being oppositely disposed and having adjacent first and second inner edges, a thermal barrier between said first and second base wall portions to thermally isolate said first and second beam sections, and fastening means to fasten said first and second base wall portions together adjacent said inner edges with said thermal barrier between opposed portions of said first and second base wall portions to form a composite beam, said fastening means being provided by first and second inner sections extending in from an inner edge and along said first and second base wall portions, said first and second inner sections having a first hook having a first opening in said first section and a second hook having a second opening in said second section interhooking with said first hook, said inner sections being roll-formed to form a continuous seam along the center of said composite beam, and a bend in one of said base wall portions of one of said beam sections, said bend being disposed opposite and extending transverse to the opening of the hook of said one beam section and opposite the hook of the other of said beam sections to prevent separation of said interhooking hooks, said bend being in the form of an indentation in a bottom face of said one beam section extending in an upward direction.

12. A method of making a metal beam with a thermal break between opposite sides comprising the steps of:

providing a first metal beam section including a first base wall portion having a first inner edge and a first side wall portion extending transverse to said first base wall portion, providing a second metal beam section, said second beam section including a second base wall portion having a second inner edge and a second side wall portion extending transverse to said second base wall portion, positioning said first and second base wall opposite one another in an overlapping relation to provide overlapping portions with said edges in a juxtaposed relation, positioning a thermal barrier between said overlapping portions of first and second base wall portions, and mechanically fastening said first and second base wall portions together adjacent said inner edges with said thermal barrier between said overlapping portions of said first and second base wall portions to thermally isolate said first and second beam sections and to form a structural composite beam, said fastening being provided by forming a first hook having a first opening in said first metal beam section and a second hook having a second opening in said second metal beam section that interhooks with said first hook, compressing said first and second hooks together by roll forming to form a continuous seam and provide a rigid connection between said first and second beam sections and forming a bend in one of said base wall portions of one of said beam sections, said bend being disposed opposite and extending transverse to the opening of the hooks of said one beam section and opposite the hooks of the other of said beam sections to prevent separation of said interhooking hooks.

13. A method of making a metal beam with a thermal break between opposite sides comprising the steps of:

providing a channel shaped metal beam, slitting said channel shaped metal beam along an intermediate portion to form a first metal beam section and a second metal beam section, said first metal beam section including a first base wall portion having a first inner edge and a first side wall portion extending transverse to said first base wall portion, said second metal beam section including a second base wall portion having a second inner edge and a second side wall portion extending transverse to said second base wall portion, positioning said first and second base wall portions opposite one another in an overlapping relation to provide overlapping portions with said edges in a juxtaposed relation, positioning a thermal barrier between said overlapping portions of first and second base wall portions, and mechanically fastening said first and second base wall portions together adjacent said inner edges with said thermal barrier between said overlapping portion of said first and second base wall portions to thermally isolate said first and second beam sections and to form a structural composite beam.

14. A method of making a metal beam with a thermal break between opposite sides comprising the steps of:

continuously roll forming first and second metal beam sections each having a base wall portion and a side wall portion extending transverse to the base wall portion, gradually roll forming an inner edge section of the base wall portion of the first beam section into a first hook having a first opening, and at the same time gradually roll forming an inner edge section of the base wall portion of said second beam section into a second hook having a second opening, and interposing a thermal material between said first and second hooks and mechanically interlocking the first and second hooks together in an overlapping interhooking relation to form overlapping portions, forming a bend in one of said base wall portions of one of said beam sections, said bend being disposed opposite and extending transverse to the opening of the hook of said one beam section and opposite the hook of the other of said beam sections to prevent separation of said interhooking hooks, and further compressing the interlocked hooks together to form a composite beam with a continuous seam with said thermal material forming a thermal barrier and a rigid connection between said overlapping portions of first and second beam sections that is not separated when structural loading forces are applied to said composite beam.

15. A method as set forth in claim 14 wherein said first and second openings face in opposite directions.

16. A method as set forth in claim 14 including the steps of:

gradually bending said first inner section to form a downturned first hook and said second inner section to form an upturned second hook, interhooking said first and second hooks to form overlapping portions, placing a layer of thermal insulation between said overlapping portions of first and second hooks and compressing said hooks together to form a continuous seam.

17. A method as set forth in claim 14 including the steps of:

gradually bending said first inner sections into a downturned first hook and said second end section into an upturned end section inside said first hook, placing a layer of heat insulation between said first hook and end section, turning said first hook and end section from an upright to a horizontal position to form a second hook interhooking said first hook and compressing said first and second hooks together to form said seam.

* * * * *